United States Patent [19]

Williams

[11] 4,082,047

[45] Apr. 4, 1978

[54] MODULAR VISITOR STATION

[75] Inventor: Charles V. Williams, Charlotte, N.C.

[73] Assignee: Southern Business Systems of Greensboro, Inc., Greensboro, N.C.

[21] Appl. No.: 784,229

[22] Filed: Apr. 4, 1977

[51] Int. Cl.[2] ..... E05G 5/00

[52] U.S. Cl. ..... 109/21.5

[58] Field of Search ..... 49/171; 109/10, 21.5

[56] References Cited

U.S. PATENT DOCUMENTS

| | | | |
|---|---|---|---|
| 1,977,719 | 10/1934 | Forsell | 109/21.5 |
| 2,045,424 | 6/1936 | Tracy | 109/21.5 |
| 2,057,239 | 10/1936 | Leversedge | 109/21.5 |
| 3,203,052 | 8/1965 | Curtis | 49/171 X |
| 3,298,329 | 1/1967 | Carstens et al. | 109/10 |
| 4,001,970 | 1/1977 | Miyamoto | 49/171 |

*Primary Examiner*—Paul R. Gilliam

*Assistant Examiner*—David H. Corbin

*Attorney, Agent, or Firm*—Joseph H. Heard

[57] ABSTRACT

The visitor station permits good visual and voice communication between persons, such as a visitor and an inmate, disposed on opposite sides of a wall within a jail, prison or similar institution, but prohibits physical contact and the passage of drugs and other materials between such persons. The modular and adjustable construction of the station permits its expeditious and economical installation, from prefabricated components and in either one-unit or multiple-unit arrays, in institutions having different size requirements. Each unit of the station includes, in addition to other components, a hollow box-like member which transmits sound both through its hollow interior and through its structure between persons using the unit, and which also provides shelf-like areas usable for writing and similar purposes by such persons.

10 Claims, 6 Drawing Figures

MODULAR VISITOR STATION

BACKGROUND OF THE INVENTION

This invention relates to visitor stations of the types employed in jails, prisons and similar institutions for the purpose of permitting visual and voice communication between a visitor and an inmate, or between similar persons disposed on opposite sides of a wall within such an institution, while at the same time prohibiting physical contact and the passage of drugs and other materials between such persons.

Prior U.S. patents disclosing visitor stations of the aforesaid general type include the following: U.S. Pat. Nos. 2,259,751, 2,057,239, 2,045,424, 1,977,719, 1,869,266, 1,741,917, 1,697,445, 1,689,172, 1,656,910, 1,635,650, 1,629,371 and 1,562,811.

Visitor stations of the above described type are subject to a number of requirements which to some extent are inconsistent or in conflict with one another. The visitor stations should of course adequately fulfill their basic function of permitting good visual and voice communication between persons using the same, and should at the same time provide such users with at least a minimal degree of privacy and convenience. In the latter regard, for instance, the visitor stations should provide an area usable for writing purposes by an attorney or similar visitor. On the other hand, the visitor stations must not permit physical contact or the passage of narcotics or other materials between users of the station, and must otherwise satisfy the usually-rigid security requirements of the institutions within which they are employed. Lastly, but also quite importantly, the visitor stations should be highly durable and economical to fabricate, install and maintain. Heretofore the cost of providing visitor stations in prisons and similar institutions has usually been quite large. Such high cost has been attributable in large part and in many instances to the visitor stations' lacking any significant degree of versatility of utilization, which required that they be individually "tailor made" on the institutional job-site, by relatively highly-skilled and thus highly-paid workmen who therefore had to travel to and be present at such job-site, to meet the particular size-specifications of each institution wherein a visitor station was to be installed.

SUMMARY OF THE INVENTION

With the foregoing in mind, the present invention provides an improved visitor station, for jails, prisons and similar institutions, which admirably fulfills the hereinbefore discussed communication, security, privacy, convenience and durability requirements, and which at the same time possesses a highly-desirable versatility which contributes significantly to its economical manufacture and installation. In the latter regard, the visitor station of the present invention is of a modular and largely pre-fabricated construction which permits its expeditious installation, in either single-unit or multiple-unit arrays and in different institutuions whose size-specifications may not be precisely the same, by workmen possessing only modest degrees of skill and relatively simple tools. In a preferred embodiment of the visitor station, each unit comprises a frame assembly which is readily adjustable so as to fit securely within wall-mounting openings of differing sizes; a pane of transparent and bullet-resistant glass or simiar material mounted within and generally centrally of the open center section of the frame assembly; and an elongate, hollow box-like member which underlies the aforesaid transparent pane within the open center section of the frame assembly and which projects distally and generally horizontally outwardly from such frame assembly and from opposite sides of the wall supporting the same. The box-like member, which is of essentially unitary construction, includes a top panel component having perforate surface portions adjacent its central area and larger imperforate surface portions adjacent its opposite ends. Sound is transmitted between persons using and disposed on opposite sides of the visitor unit both through the hollow interior and through the structure of at least the uppermost panel component of the box-like member, which insures good voice communication even when the persons using the unit are speaking in only normal conversational tones and are disposed relatively distant from the center of the visitor unit. The considerable length of the box-like member tends to space persons using the unit from its center portion, which is desirable, and permits the imperforate end portions of the top panel of the member to be conveniently employed as table or shelf-like areas usable by the visitor and/or the inmate for writing or similar purposes.

The passage of drugs or other materials between persons using the visitor unit, through the hollow interior of the box-like member and via the perforations within the perforate surface portions of its top panel component, is discouraged both by the relatively small size of such perforations and by the tendency of the length of the box-like member to maintain such persons relatively distant from the center of the unit. Additionally, baffle means are provided within the interior of the box-like member. The baffle means is so constructed as to further minimize the possibility of the passage of drugs or similar materials through the box-like member, while at the same time permitting the desired passage of sound between persons using the visitor unit.

A plurality of the aforesaid units, in only slightly modified form, may be installed in side-by-side relationship to each other to provide a visitor station containing virtually any desired number of units in institutions where a single-unit station would be inadequate. In a multiple-unit array visitor station, each unit of course still possesses its own independent box-like member, which contributes toward the ability of persons using any unit to still converse in relative privacy without interference from conversations transpiring at other units of the array. Additional benefits are obtained in the latter regard by sound-focusing partition members which are disposed between adjacent ones of the units of the multiple-unit array, and which are also employed in a single-unit visitor station.

DESCRIPTION OF THE DRAWINGS

Still other features of the invention will be apparent from the following description of an illustrative embodiment thereof, which should be read in conjunction with the accompanying drawing, in which.

DESCRIPTION OF THE PREFERRED EMBODIMENT

Referring more particularly to the drawings, the numeral 10 in FIGS. 1–5 designates in its entirety a visitor station unit adapted to be mounted and used in association with a masonry or similar wall 12 (FIGS. 3–5), having a generally rectangularly-shaped opening 14 extending therethrough, within a jail, prison or similar institution. As will be readily appreciated by those skilled in the art, the purpose of unit 10 is to permit good visual and voice communication, under conditions affording at least modest degrees of privacy and convenience, between a prisoner or other inmate disposed upon one side of wall 12 and a visitor, attorney or other person disposed on the opposite side of the wall, while at the same time not permitting the passage of drugs or similar materials between such persons or otherwise detracting from the security-requirements of the institution within which the unit is employed.

Figure 1:
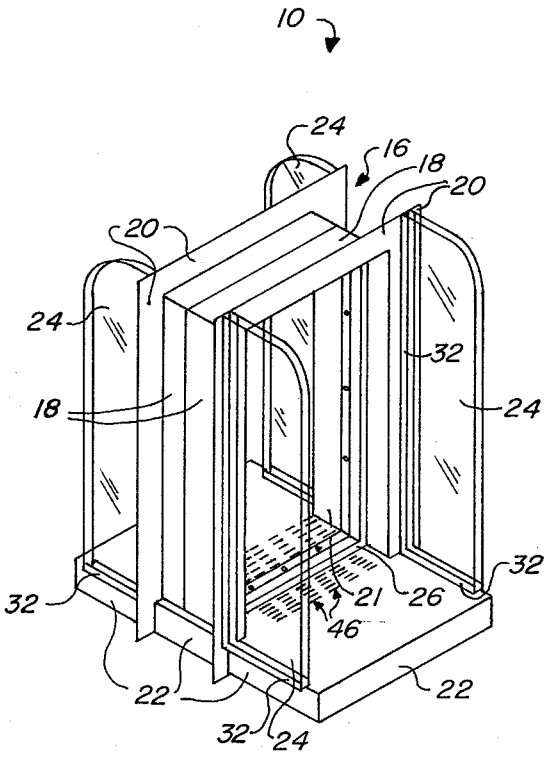
FIG. 1 is a front perspective view of a visitor station unit in accordance with the invention, as the unit would appear when assembled in association with the opening of a wall or the like, not shown in FIG. 1, of a jail, prison or similar institution.
Figure 2:
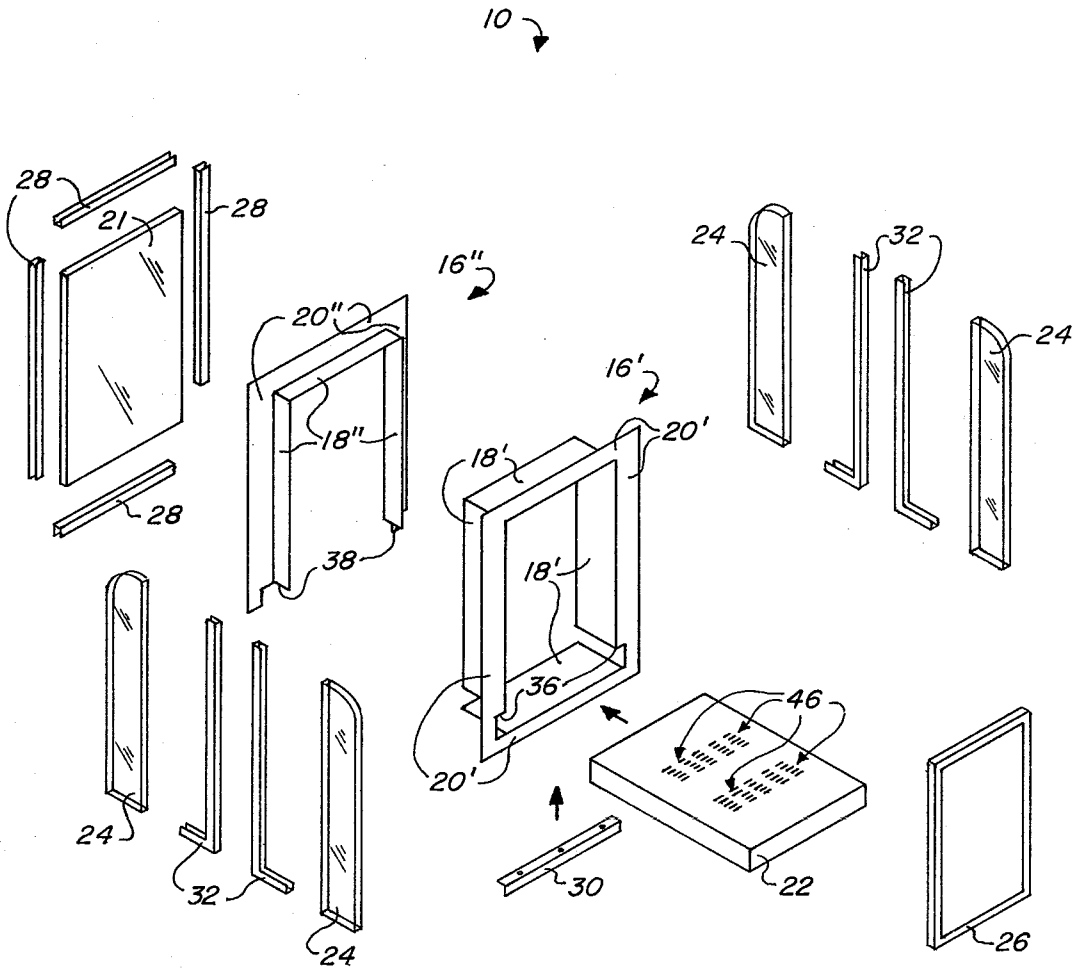
FIG. 2 is a reduced-scale exploded perspective view of the visitor station unit of FIG. 1.

Unit 10 is comprised of prefabricated components which are capable of being economically mass produced at any convenient central location and, following their shipment to a prison or other institution, of being quickly and easily assembled and installed even by workmen possessing only modest skills and relatively simple tools. As is best shown in FIGS. 1 and 2, the components of unit 10 include a generally rectangularly-shaped frame assembly 16 comprised of telescopically mating and adjustable frame members 16', 16'' which collectively define a main body portion 18 and flange portions 20 of assembly 16; a slab-like pane 21 of transparent and bullet-resistant glass or similar material dimensioned for substantially upright mounting within and generally centrally of the open center section of frame assembly 16; combination sound-box and shelf means in the form of an elongate, hollow box-like member 22 adapted to extend generally horizontally through the open center section of frame assembly 16, in underlying relationship to transparent pane 21, and to project considerable distances at its opposite ends outwardly from the frame assembly; four sound-focusing partition members 24; and a plurality of bracket members 26, 28, 30, 32 and screws or similar fastener elements 34 (FIGS. 4 and 5) adapted to secure certain of the aforesaid components in proper assembled relationship to each other and thus to secure the assembled unit 10 within the wall opening 14 of a prison or other institution. With the exception of transparent pane 21 and partitions 24, all of the aforesaid components are preferably formed of stainless steel or similar strong, durable and easily-maintainable material. All of the screw-type fasteners 34 preferably are of the so-called "jail-house" type which, once in place, are incapable of being removed by the use of a conventional tool such as a screwdriver.

Frame member 16' of frame assembly 16 includes a main body portion 18' having laterally-projecting flanges 20' formed integrally with and projecting perpendicularly from the outermost edges of its top, bottom and side sections. The lower ends of the side sections of main body portion 18' and the flanges formed integrally therewith are partially cut-away to define an opening 36. Box-like member 22 is closely received by opening 36 and projects outwardly at its opposite ends approximately equal distances forwardly and rearwardly from frame member 16'. The four-sided bracket member 26 which is best shown in FIG. 2, and is comprised of interconnected angle members, extends about the periphery of that portion of the open section of frame member 16' above the central portion of box-like member 22. Members 16', 22 and 26 are securely welded to each other, after being fitted together in the aforesaid fashion, at the place of their manufacture. They therefore comprise an integral sub-assembly for purposes of subsequent installation of unit 10.

Frame member 16'' is similar to frame member 16' in that it includes a main body portion 18'' having flanges 20'' formed integrally with and extending perpendicularly from the outer edges of its top and side sections. However, member 16'' is generally of the inverted U-shaped configuration, being open at its lower end. The lower extremities of side flanges 20'' of member 16'' are partially cut-away, as indicated by the numeral 38 in FIG. 2, to permit the projection therethrough of box-like member 22. The width of main body portion 18'' of member 16'' is slightly greater than the width of main body portion 18' of member 16', such that the members 16', 16'' fit together in partially nested or telescoping relationship to each other. This permits quick and easy adjustment of the depth or thickness dimension of the complete frame assembly 16 comprised of members 16', 16''.

Figure 3:
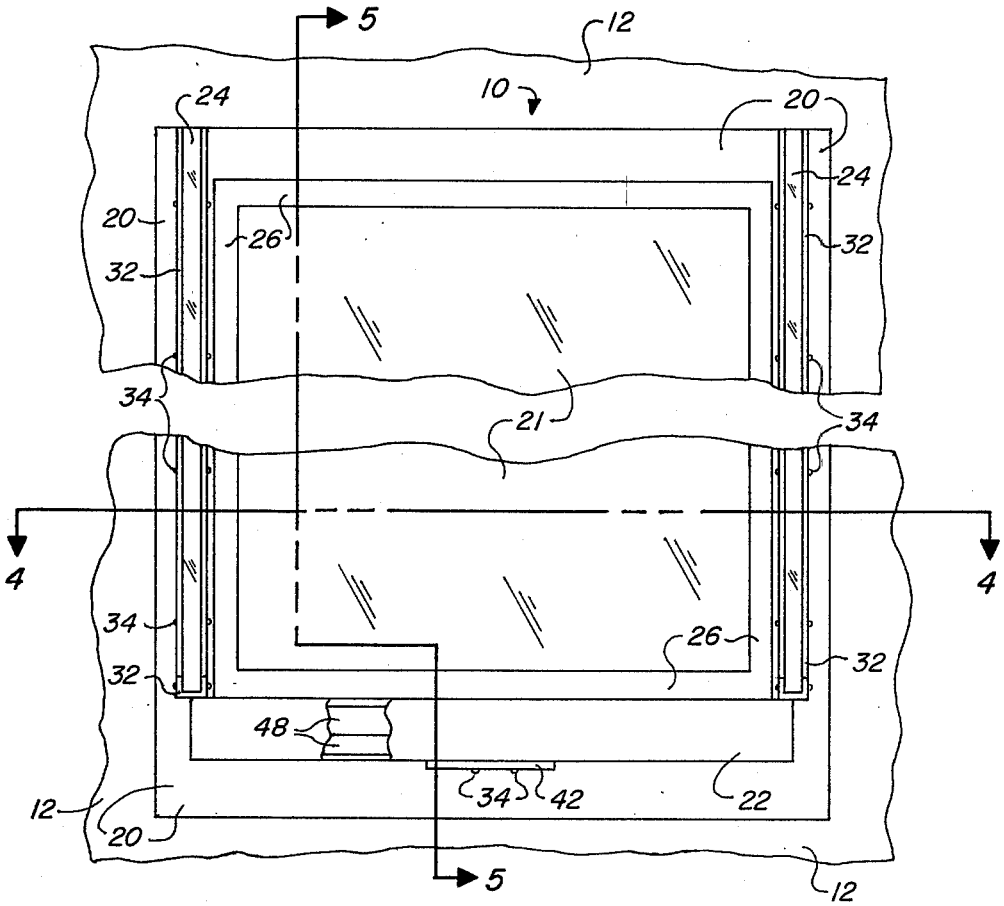
FIG. 3 is an enlarged front elevational view, partially broken-away, of the visitor station unit of FIG. 1, and of the wall of an institution wherein the unit is installed.
Figure 4:
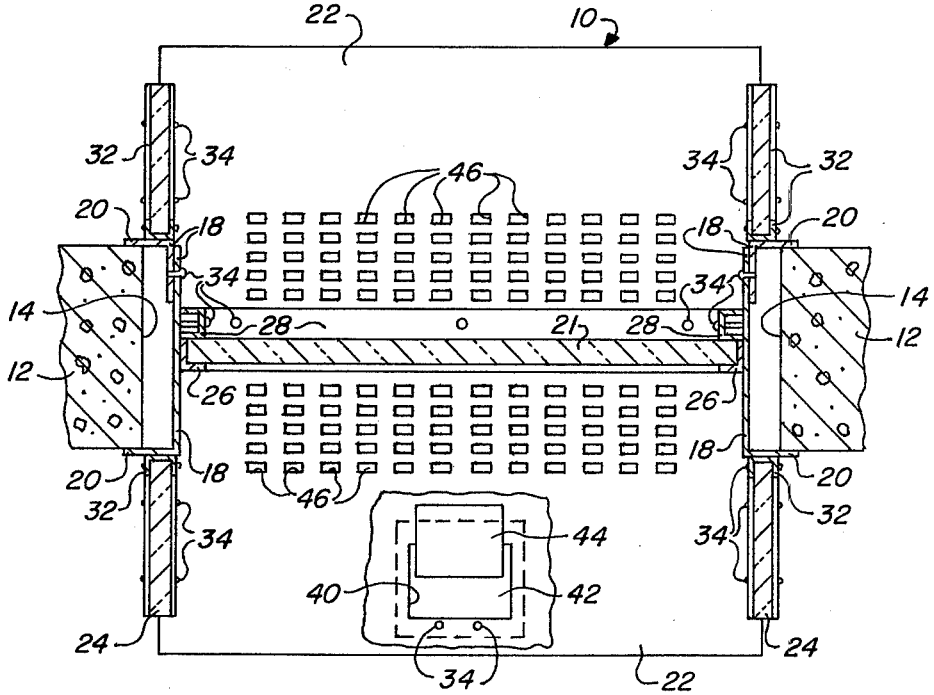
FIG. 4 is a horizontal section, partially broken away, taken substantially along the line 4—4 through the visitor station unit and wall of FIG. 3.
Figure 5:
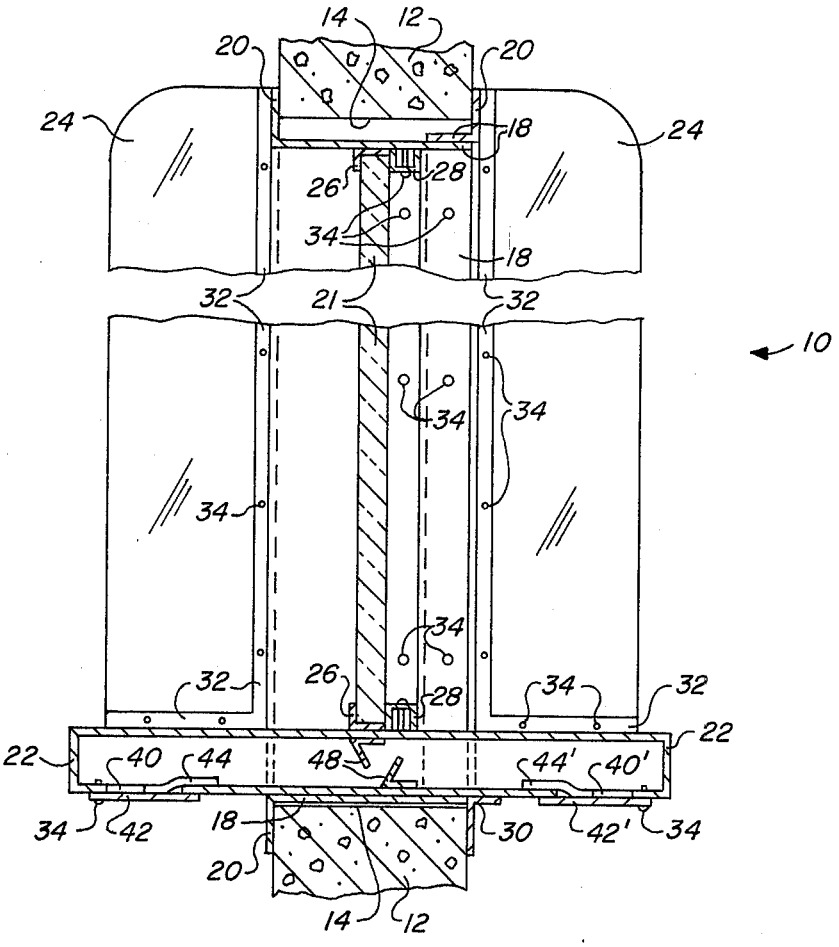
FIG. 5 is a vertical section, broken away intermediate its heigth, taken substantially along the line 5—5 through the visitor station unit and wall of FIG. 3.

In installing unit 10 within the opening 14 of an institutional wall 12 such as shown in FIGS. 3–5, frame member 16' (to which members 22, 24 have already been welded) is first inserted into such opening with the bottom section of its main body portion 18' resting upon the undersurface of the opening. The four flanges 20' of member 16' abut and overlie wall surfaces adjacent opening 14 on that side of wall 12 from which member 16' was inserted. This preferably is the "visitor" side of wall 12. Member 16'' is then inserted into opening 14 from the other "inmate" side of wall 12, with its main body portion 18'' overlying the adjacent top and side sections of main body portion 18' of member 16'. Member 16'' is moved into opening 14 until its top and side flanges 20'' abut and overlie the confronting wall surfaces adjacent opening 14 upon the "inmate" side of wall 12. Fasteners 34 are then inserted through the contiguous telescopically-arranged sections of main body portions 18', 18'' of members 16', 16''. This simultaneously fixedly secures members 16', 16'' to each other and, due to the abutment of flanges 20', 20'' with opposite side surfaces of wall 12, secures the resulting frame assembly 16 within opening 14 of wall 12. Lastly, and as an additional safeguard, angle bracket 30 preferably and illustratively is secured by fasteners 34 to the bottom panel of the box-like member 22 welded to frame member 16', at a location such that the vertical flange of bracket 30 abuts and overlies the "inmate" side of wall 12 immediately beneath opening 14.

It will therefore be appreciated that installation of frame assembly 16, and therefore of the members 22, 26 secured to its component 16', within an opening 14 of wall 12 can be quickly and easily accomplished even by workmen possessing only modest skills. It will also be noted that the foregoing installation can still be readily performed even if the thickness of wall 12, and/or the dimensions of the opening 14 therein, should not be precisely the same as those shown in FIGS. 3–5. If the heigth or width dimensions of opening 14 should vary somewhat from those shown, flanges 20 of frame assembly 16 would simply overlap the adjacent wall surfaces which they overlie to a greater or lesser extent. Similarly, if wall 12 were of a somewhat greater thickness than that shown, members 16', 16" would simply be telescoped or nested relative to each other to a correspondingly lesser extent, prior to being joined together by fastener elements 34. Ease of installation is further enhanced by the fact that no fasteners need be or are inserted into wall 12, which thus eliminates the need for "anchors" of the type which customarily must be employed to secure fasteners to concrete or masonry structures.

Pane 21 and partitions 24, if not previously affixed to the above-described components in the central location of their manufacture, are next affixed thereto so as to complete the installation of unit 10. Pane 21 is inserted into the central opening of frame 16 from the "inmate" side of wall 12, and is closely received within the bracket member 26 welded to the frame and to the box-like member 22. U-shaped brackets 28 are then secured by fasteners 34 in abutting relationship to the peripheral edges of pane 21 on the "inmate" side thereof. The lowermost bracket 28 overlies and is secured to the central portion of the top panel of box-like member 22. The remaining three brackets 28 overlie and are secured to contiguous surfaces of main body portion 18 of frame assembly 16. Partition members 24 are preferably and illustratively formed of transparent plastic material, such as that commercialized under the trademark PLEXIGLAS. For each of the four partitions 24, there is a corresponding mounting bracket 32 of generally L-shaped configuration. The shorter leg of each L-shaped bracket 32 rests upon a peripheral side portion of the top panel of box-like member 22, with the central longitudinal axis of the shorter bracket leg lying in approximately the same vertical plane as that containing the side edge of member 22 which is disposed beneath the bracket member. The longer leg of each L-shaped bracket 32 overlies a corresponding one of the four side flanges 20 of frame assembly 16, and also overlies a corresponding one of the four side flanges 20 of frame assembly 16, and extends to the top of such flange. Each bracket 32 is of generally channel-like cross-sectional shape and has a plurality of countersunk bores through the web portion of its longer leg. The longer legs of brackets 32 are secured to the frame-assembly flanges 20 which they overlie by fasteners 34 which are inserted through such countersunk bores (not shown in the drawings) prior to the placement within the brackets of corresponding ones of the partitions 24. Each partition 24 is secured to its associated one of the brackets 32, following insertion of its bottom and rear edge portions therein, by additional fasteners 34 which project through the thickness dimensions of the aforesaid components.

Elongate box-like member 22 includes, in addition to its previously-mentioned top and bottom panels, interconnecting side and end panels. Member 22 is essentially of integral, unitary construction except for its inclusion of means permitting access to its interior, for cleaning purposes when required, by authorized persons. Such access means includes an access port 40 which is provided within that portion of the bottom panel of member 22 upon the "visitor" side of unit 10 and wall 12. Port 40 is normally closed by a cover plate 42 secured by a projecting tang 44 and one or more fasteners 34 to the bottom panel of member 22 in underlying relationship to port 40. Removal of plate 42, and therefore access to the interior of member 22, can be accomplished only by authorized persons possessing the special tool required for removal of the "jail-house" type of fasteners 34. Corresponding access means, the components of which are designated in FIG. 5 by the same reference numerals with the addition of a prime designation, are provided in association with that portion of the bottom panel of member 22 upon the other, "inmate" side of unit 10 and wall 12. The top panel of box-like member 22 has a plurality of slot-like perforations 46 extending through those surface portions thereof immediately adjacent and on opposite sides of the pane 21 extending upwardly therefrom. The slot-like openings or perforations 46 permit passage of sound into and from the interior of box-like member 22, but are so small as to discourage attempted passage of drugs or similar prohibited materials through the interior of member 22 between persons disposed on opposite sides of wall 12. To further minimize the possibility of such passage of materials through the interior of box-like member 22 baffle means extend within and across the entire width of member 22, at approximately the center thereof. Such baffle means comprises top and bottom baffle members 48 (FIGS. 3 and 5) which are welded or otherwise fixedly secured to the interior surfaces of the respective top and bottom panels of member 22. Each baffle member 48 is of generally V-shaped cross-sectional configuration, and includes a flange portion which extends angularly from the top or bottom panel to which such baffle member 48 is secured. The length of the angularly extending flange of each baffle member 48 is such that the same projects through the imaginary horizontal plane disposed midway between and parallel to the top and bottom panels of member 22, but terminates in vertically spaced relationship to the one of such panels toward which the flange extends.

As noted previously, the length of box-like member 22 is such that the same projects at its opposite ends considerable and approximately equal distances outwardly from frame assembly 16 and wall 12. This permits the top panel of member 22 to include imperforate surface portions, adjacent its opposite ends, whose size is greater than that of the panel's inwardly-disposed perforate surface portions and which therefore may be conveniently employed as table or shelf-like areas to support writing materials or other articles belonging to the persons disposed on opposite sides of unit 10. The considerable length of box-like member 22 also contributes to discouraging attempted passage of drugs or other prohibited materials through the interior of member 22, since it spaces persons using the unit further away from the perforate surface portions adjacent the center of the top panel of member 22.

Notwithstanding their being spaced a considerable distance apart, persons using unit 10 and disposed on opposite sides of wall 12 can readily hear one another when speaking in only normal conversational tones. In the latter connection, part of the sound transmission between persons using unit 10 is by way of the perforate surface portion of the top panel of member 22 on one side of pane 21, thence through the interior of member 22 and the tortuous passage between top and bottom baffles 48, and thence through the perforate surface portion of the top panel upon the opposite side of pane 21. The aforesaid sound transmission is enhanced by, firstly, the partition members 24 which minimize lateral dispersion of the sound waves and direct the same from the speaking person to the perforate surface portion of member 22 on the speaker's side of unit 10, while on the opposite side of the unit directing the sound waves exiting from the other perforate surface portion of member 22 toward the listening person. Secondly, member 22 functions as a sound-box to enhance the resonance of the sound transmitted along the aforesaid path of travel, and to itself provide an additional anciary path of travel for transmitting sound waves and/or vibrations between persons using unit 10. Thus, sound waves produced by the voice of a person on one side of unit 10 tend to cause vibrations of particularly the top panel of member 22, and to a lesser extend also of its bottom and side panels, which vibrations are transmitted through the structure of member 22 and cause corresponding vibrations and sound upon the opposite side of the unit. This desirable effect is attributable to the aforesaid panels each individually being of continuous and relatively thin construction, although collectively forming a quite strong and rigid box-like member 22, and extending in unitary fashion completely through and considerable distances beyond the opposite sides of wall 12.

Figure 6:
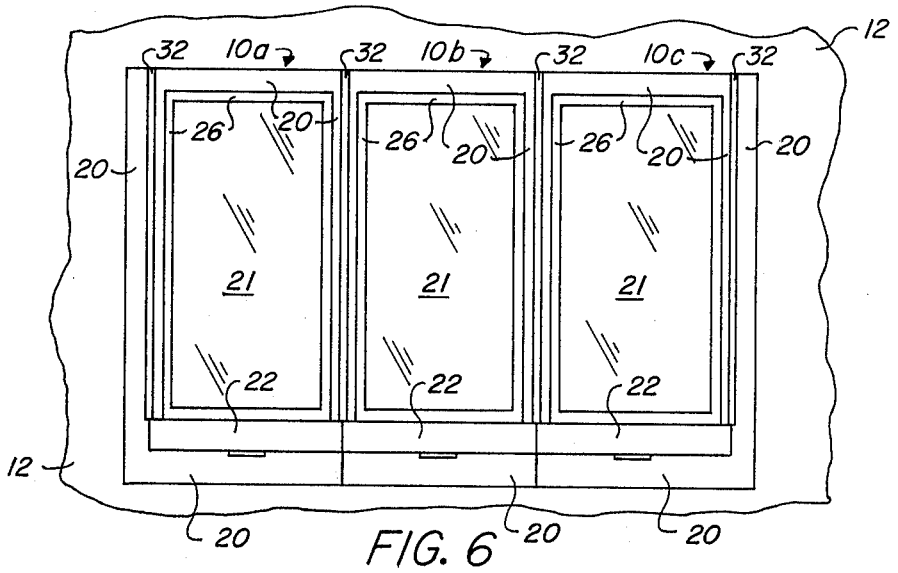
FIG. 6 is a reduced-scale front elevational view of a visitor station comprised of a plurality of units of a construction similar to that of FIGS. 1–5.

The visitor station of the present invention may also be installed when desired in arrays of two, three or any desired greater number of the units 10. FIG. 6 shows a multiple-unit array which illustratively includes three visitor-station units 10*a*, 10*b* and 10*c* mounted in side-by-side relationship to each other. The center unit 10*b* of the FIG. 6 array is identical to the unit 10 previously described and shown in the other figures of the drawings, except for the opposite side flanges 20 of its frame assembly being more narrow; i.e., each side flange 20 of unit 10*b* terminates at approximately the vertical plane containing the thereto-adjacent side panel of box-like member 22 of the unit. The "interior" side flanges 20 of the frame assemblies 16 of each of the end-most units 10*a*, 10*c* of the FIG. 6 array similarly possess the lesser width of the side flanges of unit 10*b*. Such smaller flange width reduces the overall width of the array of units 10*a*, 10*b*, 10*c*, and eliminates the relatively-large "gaps" or spaces which would otherwise be present betweeen the members 22 of adjacent ones of the units. Throughout all portions of their heights above members 22, the junctures between the abutting flanges 20 of adjacent ones of the units 10*a*, 10*b* and 10*c* are overlaid and joined together by corresponding ones of the L-shaped partition-mounting brackets 32. In a multiple-unit visitor station, such as shown in FIG. 6, it will be noted that less than four partition members 24 per unit are required and employed, since the partitions 24 at each "interior" side of a unit 10 of the array serves both such unit and the unit immediately adjacent thereto. Installation of a multiple-array visitor station is performed in essentially the same manner as is the installation of a single-unit station. However, if a large number of units 10 are included in the multiple array, it may also be desirable to join together the main body portions 18 of adjacent ones of of the frame assemblies 16 of the units, at those locations where the vertical side sections of such main body portions extend in spaced parallel relationship to each other. This may conveniently be accomplished by the use of fastener elements longer than but otherwise the same as the fastener elements 34 employed as shown in FIGS. 4 and 5 to secure together the mating members 16', 16'' of frame assembly 16.

In a multiple-unit visitor station such as shown in FIG. 6, each unit 10 of course still possesses its own separate box-like member 22. This is highly desirable since if a single enlarged sound-box member spanned the entire width of the total array of units, conversations at any one unit would likely be overheard by persons using an adjacent unit and/or would interfere with such other persons' conversation.

While a preferred embodiment of the invention has been specifically shown and described, it is to be understood that this is for purposes of illustration only, and not for purposes of limitation, the scope of the invention being in accordance with the following claims.

That which is claimed is:

1. A modular visitor station for use in a jail, prison or similar institution including a wall having an opening therein, said visitor station including at least one unit for permitting visual and voice communicating between first and second persons respectively disposed on opposite sides of said wall while prohibiting contact and the passage of materials between said persons, said unit comprising:

an upright frame assembly having a main body portion with an open center section mounted within said opening, and with a bottom section disposed in closely adjacent overlying relationship to the bottom extremity of said opening; and peripheral flange means formed integrally with and extending laterally from said main body portion and overlying surfaces of said wall, on both sides of said wall and adjacent said opening therein, for securing said main body portion within said opening;

a generally vertically extending transparent viewing pane fixedly mounted within said center section of said main body portion of said frame assembly, at a location approximately midway of the depth dimension of said frame assembly, for permitting visual communication between persons disposed on opposite sides of said wall;

and combination sound-box and shelf means extending generally horizontally, in underlying relationship to said transparent pane and in overlying engaging relationship to said bottom section of said main body portion of said frame assembly, through and outwardly from said open center of said frame assembly; said combination means comprising an elongate, hollow box-like member, of essentially unitary construction including vertically-spaced and generally parallel top and bottom panels, fixedly secured centrally of its length to said frame assembly and projecting in the direction of its opposite ends freely and distally outwardly from said frame assembly and from the opposite sides of said wall; the said top panel of said box-like member having perforate surface portions adjacent to and on opposite sides of said transparent pane and having relatively larger imperforate surface portions adjacent its opposite ends, said member being adapted to transmit sound through its interior and through at least said top panel thereof between persons upon opposite sides of said wall, and said imperforate surface portions of said member defining shelf-like areas respectively usable for writing and similar purposes by persons on opposite sides of said wall.

2. A visitor station as in claim 1, wherein said frame assembly includes first and second frame members each having main body portions projecting into said opening from opposite sides of said wall and telescopically mating with each other to permit adjustment of the depth dimension of said frame assembly, defined by said frame members, in accordance with the depth dimension of said wall opening; said main body portion of said first frame member being of generally rectangular configuration and comprising integrally formed top, bottom and side sections extending in substantially parallel adjacent relationship to corresponding ones of the top, bottom and side extremities of said opening; said bottom section of said first frame member defining said section of said frame assembly overlying the bottom extremity of said opening; said main body portion of said second frame member being generally of inverted U-shaped configuration and comprising integrally formed top and side sections disposed in overlying engagement with corresponding ones of said top and side sections of said main body portion of said first frame member; and said side sections of said main body portion of said second frame member terminating in closely adjacent overlying relationship to said top panel of said elongate hollow box-like member.

3. A visitor station as in claim 2, and further including fastener means extending through said top and side sections of said main body portions of said frame members for fixedly securing said frame members in desired positions of telescopically mated relationship to each other.

4. A visitor station as in claim 3, wherein said box-like member is rigidly attached to said main body portion of said first frame member prior to mounting of said frame assembly within said wall opening, and further including an angle bracket secured to said bottom panel of said box-like member and having flange means overlying a surface of said wall adjacent said opening therein, said unit being maintained within said wall opening solely by said overlying flange means of said frame assembly and of said angle bracket upon the securing of said frame members to each other and the securing of said angle bracket to said box-like member.

5. A visitor station as in claim 1, and further including generally vertically extending partition means connected to and projecting outwardly from opposite sides of said frame assembly on both sides of said wall for facilitating sound transmission between persons using said unit by restricting lateral dispersion of sound passing to and from said perforate surface portions of said top panel of said box-like member.

6. A visitor station as in claim 1, and further including baffle means disposed within and spanning substantially the entire width and heigth dimensions of said box-like member, at a location approximately mid-way of its length, for impeding attempted passage to drugs and like materials, while permitting the passage of sound, through the interior of said box-like member.

7. A visitor station as in claim 6, wherein said baffle means includes top and bottom baffle members, each of generally V-shaped cross-sectional configuration, respectively carried by said top and bottom panels of said box-like member, said top baffle member projecting toward but terminating in spaced relationship to said bottom panel of said box-like member, and said bottom baffle member projecting toward but terminating in spaced relationship to said top panel of said box-like member.

8. A visitor station as in claim 7, wherein said box-like member includes normally-closed access means for permitting access to the interior of said box-like member by authorized persons for cleaning purposes.

9. A visitor station as in claim 8, wherein said access means includes an access port within said bottom panel of said box-like member, and a cover plate removably secured to said bottom panel in underlying relationship to said access port.

10. A visitor station as in claim 1, wherein said unit comprises one of a plurality of units each of a construction similar to that of said first-mentioned unit, said units being disposed in laterally-adjacent relationship to each other with said frame assemblies of adjacent ones in abutting relationship; and further including partition means overlying and projecting outwardly from at least the junctures between the abutting frame assemblies of said adjacent ones of said units.

* * * * *